US006510808B1

(12) United States Patent
Tormålå et al.

(10) Patent No.: US 6,510,808 B1
(45) Date of Patent: Jan. 28, 2003

(54) EVACUATION REFUGE

(76) Inventors: Pasi Tormålå , PL 32, FIN-10301 Karjaa (FI); Mikael Cande, 4. Linja 17-19 F, FIN-00530 Helsinki (FI); Ilkka Pitkänen, PL 36, FIN-02771 Espoo (FI)

( * ) Notice: Subject to any disclaimer, the term of this patent is extended or adjusted under 35 U.S.C. 154(b) by 0 days.

(21) Appl. No.: 09/674,979

(22) PCT Filed: Apr. 28, 1999

(86) PCT No.: PCT/FI99/00343

§ 371 (c)(1),
(2), (4) Date: Nov. 8, 2000

(87) PCT Pub. No.: WO99/61308

PCT Pub. Date: Dec. 2, 1999

(30) Foreign Application Priority Data

May 27, 1998 (FI) ..... 981173

(51) Int. Cl.[7] ..... B63B 23/00; B63B 23/38
(52) U.S. Cl. ..... 114/365; 114/366
(58) Field of Search ..... 114/323, 348, 114/349, 350, 365, 366, 367, 376; 441/87

(56) References Cited

U.S. PATENT DOCUMENTS

| | | | | |
|---|---|---|---|---|
| 3,060,465 A | * | 10/1962 | Cartensen | 441/87 |
| 4,356,789 A | | 11/1982 | Hammett | |
| 4,365,579 A | * | 12/1982 | Perez, Jr. | 114/349 |
| 4,527,503 A | * | 7/1985 | Connelly | 114/365 |
| 4,781,144 A | | 11/1988 | O'Brien | |
| 5,210,985 A | * | 5/1993 | Hsu | 52/169.6 |
| 5,331,913 A | * | 7/1994 | Tanaka et al. | 114/259 |
| 5,765,500 A | * | 6/1998 | Nordbo | 114/366 |

FOREIGN PATENT DOCUMENTS

| | | | |
|---|---|---|---|
| GB | 2 229 402 | 9/1990 | |
| GB | 2 231 844 | 11/1990 | |
| GB | 2 275 230 | 8/1994 | |
| SU | 1691216 | * 11/1991 | 114/365 |

* cited by examiner

*Primary Examiner*—A. Joseph Morano
*Assistant Examiner*—Andy Wright
(74) *Attorney, Agent, or Firm*—Swidler Berlin Shereff Friedman, LLP

(57) ABSTRACT

An evacuation refuge for a maritime unit. A rescue station includes at least one space operable to be completely closed from a surrounding environment for longterm occupation therein. A plurality of life boats are arranged within the rescue station for emergency exit. The life boats are operable to be occupied while inside the rescue station prior to deployment. An openable or removable structure is operable to permit deployment of the life boats arranged within the rescue station by removal of the occupied life boats from the rescue station. Breathing air processing devices are operable to maintain air within the evacuation refuge breathable.

34 Claims, 3 Drawing Sheets

EVACUATION REFUGE

BACKGROUND OF THE INVENTION

The invention relates to an evacuation refuge for a maritime unit meant for maritime purposes, such as for shipping, operating at the sea and/or like, in connection with which there exists at least the said evacuation refuge for people existing on the maritime unit and life boats or like for emergency exit.

It is usual nowadays within maritime operations for e.g. shipping or operating at the sea to place the life boats e.g. on the open deck of ship or e.g. at the side of an oil drilling rig, from where the same may be lowered to the sea by dropping. This causes many problems in practice, one of the most crucial of which worth be mentioning is particularly insecurity during an actual emergency, whereby moving to the life boats takes place in open space totally exposed to the roll of the sea and weather circumstances. On the other hand one crucial problem related to the traditional type of placement of the life boats is that, that the life boats as well as the supporting and lifting apparatuses for the same are continuously under very demanding circumstances, that is why effects e.g. by corrosion can be seen already after a very short period of use. This is why the life boats and the operating apparatuses of the same require regular observation and active maintenance in order to confirm usability of the same during an actual emergency.

The problems described above are furthermore emphasized when speaking of actual maritime units, that are meant for operating at the sea, such as immovable oil drilling rig units. In this type of use such situations may arise for most heterogeneous reasons, that the personnel has to seek shelter and get prepared for emergency exit. This is why present rigs have according to the present stipulations temporary refuges, that may be closed airtight from the surroundings. Such temporary refuges are meant however for a very short stay, that is for a residence lasting about 30 minutes at the maximum. Such rooms are generally in practice usual cabins only, that have not been designed for protecting purposes so, that they could be easily separated airtight from the surroundings or that they would have structures increasing fire or explosion safety. After this time at the latest one must leave the protecting facility in question to the life boats placed at the side of the drilling rig or to the helicopter deck, in case evacuation is possible that way. The situation may thus be such, that the sea underneath and/or a part of the drilling rig is burning, whereby getting to the life boats is impossible because of toxic combustion gases existing in the surroundings or because of high temperatures. In addition to that problems may be caused under such situations also by high roll of the sea and by otherwise disadvantageous weather circumstances so, that helicopter transportations being used typically for emergency exit may not be used.

In Finnish patents numbers 96896 and 100197 there has been presented solutions, that are meant for developing particularly traditional drilling rigs of jack-up type. In this connection it may be stated, that it is nowadays known to use both so called semi-submersible drilling rigs and the type of so called jack-up drilling rigs as described above, which have feet, that may be moved with respect to the frame part of the drilling vertically in order to support the drilling rig to the bottom of the sea during an operating situation. The semi-submersible drilling rigs comprise an underwater part, which supports the actual working deck existing on the sea level. Such a drilling rig is not supported stationary on the ground at all during a drilling situation, that is why the type of drilling rig requires expensive and complicated joint and movement arrangements between the drilling device drilling the ground and the drilling rig, which enable drilling despite the roll of the sea. Both the costs of manufacturing and operating of such type of drilling rigs are multiple, when compared to the same of those drilling rigs of jack-up type described above. One crucial advantage of the type of drilling rigs above compared to nowadays drilling rigs of jack-up type is, however, that because of a massive construction of the same they may be transported in most heterogeneous circumstances, even during a relatively high roll of the sea. In addition to that, they may be used with clearly deeper depths of water than jack-up rigs, which may be used when the depth of water is usually below 150 meter.

The solutions presented in the Finnish patents mentioned above are meant particularly to improve the safety and feasibility of a drilling rig of jack-up type, whereby the former of the same is meant particularly to improve the safety and feasibility of the drilling rig in a way, that the residence unit belonging to the drilling rig is arranged moveable, whereby it is moved at least for the time of the drilling situation essentially away from the drilling unit, advantageously in a direction, that is essentially opposite to the moving direction of the drilling unit.

The latter patent discloses a solution, that is meant to improve the feasibility of a drilling rig of jackup type particularly with a view to the safety of an attachment phase and a detachment phase. In this case under the bottom of the frame part there has been arranged an airspace, that may be discharged for the transportation position of the drilling rig, whereby air is blown to the same in order to achieve an airbed or like, particularly for the time of the attachment and/or the detachment phase.

The risks related to maritime may be classified to the following main groups: cases of sinking, collision, fire, explosion and structural damage. In addition to that typical risks related particularly to off-shore oil drilling are: gas leakages, which cause danger to life due to an explosion or poisoning, oil leakages, yielding of the sea bottom, a pipe damage of the bore, helicopter accident, a threat to terrorism.

The evacuation stipulations for different kinds of risk situations are always slightly differing, but in serious cases they according to the main rule always end up to exiting the rig either by helicopter transportation or by life boats. As an example of the above increasing of hydrogen sulphide to a level of 0,04% may be mentioned. In such a case the rig must be evacuated immediately. When an evacuation is taking place, it is safest to carry it out by helicopters, in case they may be used under those circumstances or if there is enough time to use them. In case use of a helicopter is prevented because of the weather circumstances or because of urgency of the evacuation, people must enter the life boats. Moving to the life boats is always a risk already as such. It has been said, that most lives, that have been lost in sea accidents all over the world are just result of life boat accidents, because fatal accidents have occured while handling the life boats. They may be caused by the bad shape of the life boat or of its treatment apparatus, by circumstances during exit to the boats, by roll of the sea while staying in the boats and to a high degree also by exiting the life boats to the rescuing ship.

SUMMARY OF THE INVENTION

Despite the developed solutions according to the patents described above, in which there has been suggested first of all to place the helicopter deck in connection with the upper part of the residence unit above the life boats in a way, that a covered sheltering space is achieved, that protects moving of the personnel to the life boats, and on the other hand also that, that in connection with the residence unit there has been arranged built-in a sheltered emergency exit space, the present art for the part of the life boats has remained unchanged in such respect, that the life boats are completely uncovered at the sides of the drilling rig, so that the problems presented above are related also to the solutions according to the above mentioned patents.

It is the aim of the evacuation refuge according to this invention to achieve a decisive improvement in the problems presented above and thus to raise substantially the level of knowledge in the field. To achieve this aim, the evacuation refuge according to the invention is primarily characterized in, that the evacuation refuge is arranged as a rescue station, that is arranged to be closed essentially completely and preferably airtight from the surroundings and in which long lasting residence is enabled and furthermore inside of which the said life boats or like are being placed.

The evacuation refuge according to the invention improves significantly safety of maritime units meant for most heterogeneous purposes particularly with a view to different kinds of protecting, emergency, emergency exit situations or like. This is first of all thanks to the fact, that the life boats are placed in a space, which is totally protected from the surroundings so, that safe moving to the same is always enabled under most heterogeneous circumstances and surroundings. As an advantageous embodiment the evacuation refuge according to the invention is being exploited particularly in a maritime unit that is meant for operating at the sea, such as an oil drilling rig or like, whereby in connection with the rescue station there has been arranged processing devices for breathing air, such as ventilation arrangements, reserve of breathing air, regeneration and/or filtration units for breathing air, in order to keep the air suitable for breathing inside the rescue station, that is particularly to be closed airtight with respect to the surroundings, which enables long lasting residence in the rescue station. The invention has one crucial meaning in such respect as well, that the life boats, that are totally protected from the roll of sea and weather circumstances, are despite demanding surroundings maintained in good shape, whereby maintenance and service of the same may be minimized without however risking their reliability. One more advantage of keeping the life boats protected is the fact, that also the operating apparatuses of the same are kept in good condition with significantly less maintenance than presently. The evacuation refuge according to the invention improves thus significantly the general safety of maritime decreasing simultaneously significantly also maintenance and service expenses.

Advantageous embodiments of the evacuation refuge according to the invention are represented in the dependent claims related to the evacuation refuge.

BRIEF DESCRIPTION OF THE DRAWINGS

In following description, the invention is illustrated in detail with reference to the depended drawings, in which.

DETAILED DESCRIPTION OF THE INVENTION

The invention relates to evacuation refuge for a maritime unit meant for maritime purposes, such as for shipping, operating at the sea and/or like, in connection with which there exists at least the said evacuation refuge for the people existing on the maritime unit and life boats 8*a* or like for emergency exit. The evacuation refuge is arranged as a rescue station, that is arranged to be closed essentially completely and advantageously with respect to the surroundings and in which long lasting residence is enabled and furthermore inside of which the said life boats 8*a* or like are being placed.

Figure 1A:
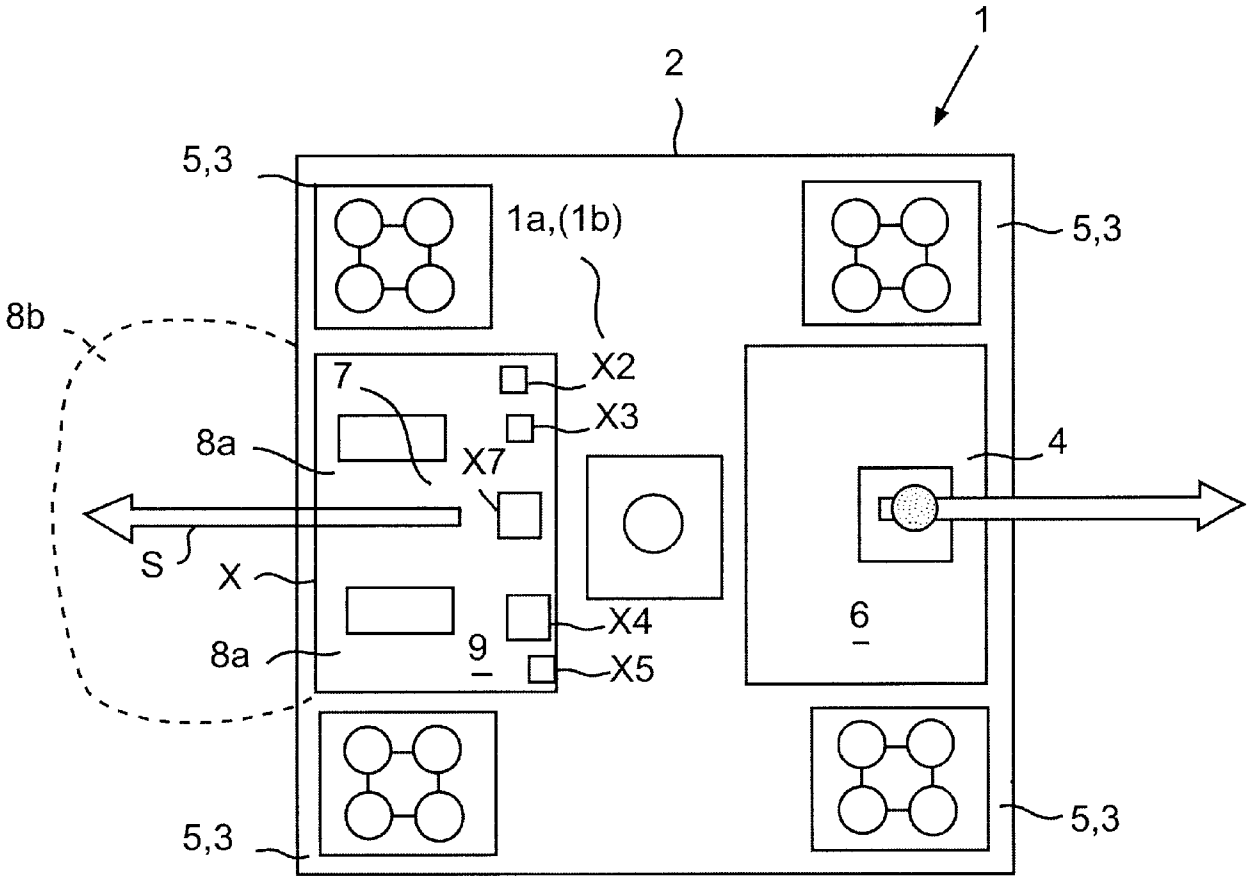
FIG. 1*a* shows one advantageous purpose for use of the evacuation refuge according to the invention, that is a drilling rig of jack-up type during a transportation situation seen from above.
Figure 1B:
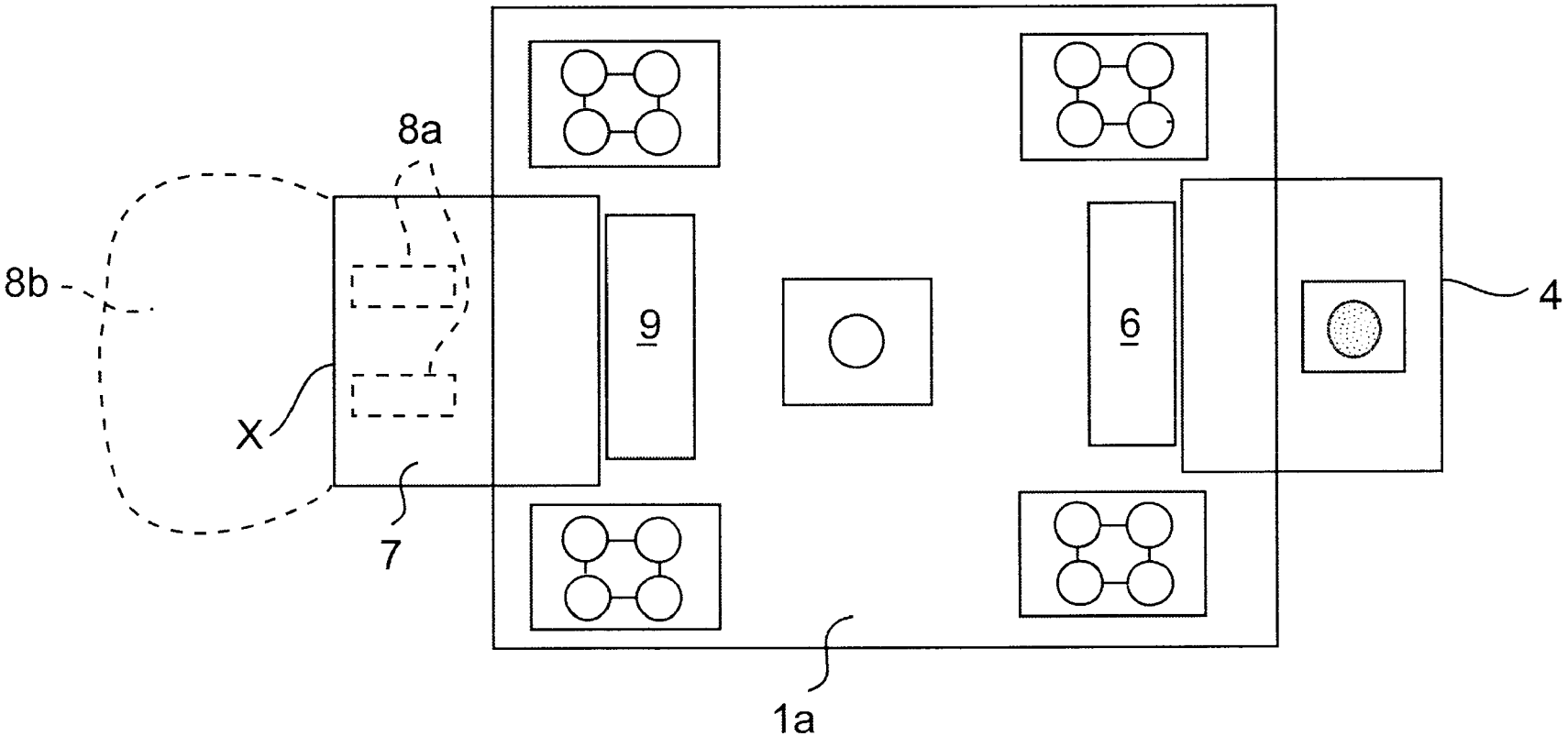
FIG. 1*b* shows the corresponding embodiment during a drilling situation and FIG. 2 shows the corresponding drilling rig during a drilling situation as a side view.
Figure 2:
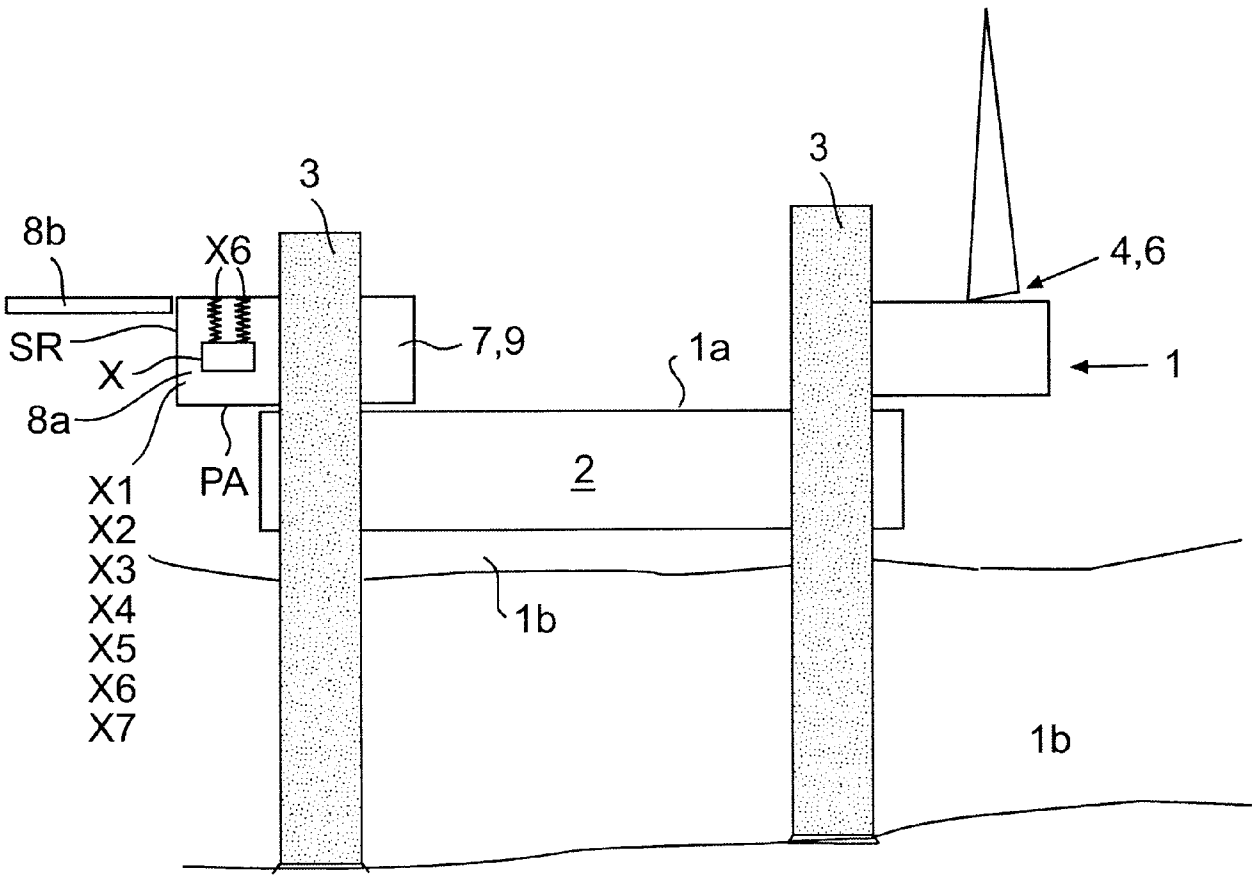

The principle above may be found from all of the FIGS. 1*a*–2, in which there is shown a drilling rig of so called jack-up type as an example of applying the invention. In this connection it must be stated, that the evacuation refuge according to the invention may naturally be used in addition to e.g. in shipping vessels in most heterogeneous maritime units meant for operating at the sea, such as e.g. in immovable oil drilling rig units or e.g. in so called rigid production plants or in those drilling rigs of submersible-type being described in the beginning. Particularly in this kind of operative use a rescue station X has been applied, that is advantageously thermally insulated and equipped with a structure reinforced against explosions and in connection with which there has been arranged furthermore processing devices X1 for breathing air, such as ventilation arrangements, reserve of breathing air, regeneration and/or filtration units for breathing air, in order to keep the air suitable for breathing inside the rescue station X, that is particularly to be closed airtight with respect to the surroundings.

As an advantageous embodiment with reference particularly to the view shown in FIG. 2, there has been arranged in connection with the rescue station X sanitary facilities X2, that are to be closed airtight with respect to the surroundings, such as WC's, chemical toilets, washing facilities and/or like.

With respect to the drilling rig 1 of jack-up type shown in FIGS. 1*a*–2, the drilling rig 1 has a frame part 2 comprising a working deck 1*a* and an essentially plane shaped bottom 1*b*, inside of which there has been arranged at least a part of the power production and operating equipment of the drilling rig 1. In connection with the frame part 2 there has been arranged at least three feet 3 operated by lifting devices 5, by means of which the drilling rig 1 may be supported on the sea bottom during an attachment phase through lowering the same from a standby position required by a transportation position of the drilling rig 1 essentially in a vertical direction in respect to the frame part 2 to a working position enabling at least a drilling situation (FIG. 2). In connection with the frame part 2 there is also a drilling unit 4 for drilling, that is arranged moveable essentially in a horizontal plane in respect with the frame part 2 by means of a first transferring apparatus 6, such as by actuators driven by electricity, pressurized medium and/or correspondingly and a slide rail assembly or a like, to perform the drilling during the drilling situation essentially form outside the frame part 2 (FIGS. 1*b* and 2). Furthermore as an advantageous embodiment the drilling rig 1 comprises also a residence unit 7, that is arranged according to the patents described in the beginning moveable at least for the time of the drilling situation essentially away from the drilling unit 4. Particularly in this type of connection there has been arranged in connection with the rescue station X a food stuffs unit X3 for food and drink maintenance enabling long standing residence, which unit is to be closed airtight with respect to the surroundings and that is preferably common to the residence unit 7, which residence unit 7 is advantageously moveable in direction s e.g. by means of a second transferring apparatus 9. In the drilling rig embodiment shown in the drawings there has been shown furthermore a helicopter deck 8*b* for air transportations, that is placed advantageously in connection with the upper part of the residence unit 7, whereby in connection with the same there has been arranged advantageously a safe exit way also directly from the rescue station to the helicopter deck.

Furthermore as an advantageous embodiment with reference particularly to FIG. 2 there has been arranged a heating/cooling apparatus X4 in connection with the rescue station X, in order to keep the temperature inside the rescue station X within preferably adjustable temperature limits.

Particularly due to risk involved with the type of operating at the sea described above, it is furthermore advantageous to arrange in connection with the rescue station X also observation arrangements X5 in order to observe the state of the surroundings visually, such as by means of windows, video cameras and/or like, and/or by measuring techniques, such as by means of gas, temperature, pressure detectors and/or like, whereby particularly by means of e.g. a gas detector it is possible to observe the carbon monoxide, combustion gases, hydrogen sulphide, hydrocarbon contents or like of the surroundings. The above described observation arrangements based on measuring techniques enable furthermore use of the processing devices X1 for breathing air so, that air, that has been purified only by a filtering unit, is being led to the rescue station X, whenever it is possible. On the other hand during very difficult situations it is possible to use the reserve of breathing air and the regeneration unit for breathing air, whereby the breathing air of the rescue station X is maintained by means of a closed cycle by limiting the carbon dioxide of the recycling air by means of the regeneration unit and by purifying it with the filtration unit.

Furthermore with reference to FIG. 2 there has been arranged to the outside wall of the rescue station X an openable/a removable wall structure SR placed essentially in connection with the life boats 8*a* in order to enable removing of the same from the side.

As an advantageous embodiment with reference particularly to FIG. 2, the bottom of the rescue station X is arranged openable/removable from under the life boats 8*a* in order to enable removing of the same from below through an exhaust opening PA formed into the bottom. It is also possible to arrange in connection with the rescue station X and/or the life boats 8*a* a folding apparatus X6 in order to lower the life boats nearer to the sea level before dropping them down. This type of arrangements are necessary particularly during such situations, when the maritime unit is for some reason in very declined position so, that the dropping height of the life boats is too high.

Furthermore as an advantageous embodiment of the invention, there has been arranged in connection with the rescue station X an extra command post X7 for controlling of the operative functionings of the maritime unit, such as of a drilling unit 4 performing drilling, of a residence unit 7, of a transferring apparatus 6, 9 and/or of an energy supply and operating apparatus of an immovable or a moveable oil drilling rig or like.

The invention described above gives extra time to make an evacuation decision and makes maybe even the whole evacuation decision unnecessary. The people may stay safely in the rescue station and monitor development of the situation from there. It is whenever possible to exit the station by going to the life boats, but however not until then, that the people are considered to be safer in the boats than in the rescue station.

It is also always possible to exit the rescue station to the helicopter deck in order to carry on the evacuation from that point. In case the weather circumstances prevent use of the helicopters, the people may in very many situations wait till the last moment sitting in the life boats if necessary and wait for improvement of the weather conditions and in case they get better, exit the station by helicopter transportation.

In many situations the invention may even make the present evacuation decisions according to the present stipulations totally unnecessary so, that the risk of danger goes by during the time, that the people spend in the rescue station; a gas leakage stops and the direction of wind changes, a fire is being extinguished etc. Rescuing may be waited for, though some kind of explosion would have destroyed structures concerning actual operations, whereby there is enough time by equipping the rescue station with equipment, that safeguard survival e.g. for two weeks.

When a premature evacuation may be avoided, also the great risks caused by the evacuation as such may be avoided. Also the high expenses must be kept in mind, that are caused by evacuation. If evacuation may be avoided at least for once, it may be, that the invention has paid back itself economically. So, the primary aim and purpose of the invention is to decrease risks involved with evacuation at the sea by increasing safety with arrangements, the costs of which are very often also more profitable that present arrangements.

It is also possible as a rescue station according to the invention is being used e.g. in passenger ships, that the passengers could be determined to go the station much earlier, than such an order about moving to the life boats would be given nowadays. There may be even certain stages during moving to the rescue station, e.g. first of all moving to the rescue station, after that transferring therein to the life boats without however discharging the life boats etc. The rescue station could be thus preventive with respect to damages. As the dangers involved with transferring to the life boats are known, such an order need not be given, but the people would however be much better prepared for leaving the ship in case a final evacuation order proves out to be necessary.

The invention causes in this connection as well many evacuation stipulations to be rewritten, but simultaneously it improves safety, spares unnecessary risks and is in most cases in addition to better safety also a more advantageous alternative.

It is obvious, that the invention is not limited to the embodiments shown or presented above, but it can be modified within the basic idea even to a great extent. Thus the evacuation refuge according to the invention may be carried out technically by very many types of constructions depending very much on the purpose for use. E.g. in connection with maritime vessels, the evacuation refuge may be arranged technically by very many kind of constructions, whereby easy entrance of the passangers and personnel to the rescue station is enabled and on the other hand also the safe lowering of the life boats from the same to the sea. In addition to that it is also possible to equip an evacuation refuge according to the invention more abundantly than described above e.g. with first aid devices and equipments, locationing devices, data communication devices etc. It is naturally advantageous to connect the rescue station according to the invention with suitable sheltered passages to certain critical points in order to enable going to the rescue station safe also.

What is claimed is:

1. An invention refuge for a maritime unit, comprising:

a rescue station comprising at least one space operable to be completely closed from a surrounding environment for longterm occupation therein;

a plurality of life boats arranged within the rescue station for emergency exit, such that the life boats are operable to be occupied while inside the rescue station prior to deployment;

an openable or removable structure operable to permit deployment of the life boats arranged within the rescue station by removal of the occupied life boats from the rescue station, wherein the openable or removable structure comprises an openable or removable bottom of the rescue station in connection with the life boats and operable to be opened or removed from under the life boats to enable removing the life boats from below through an exhaust opening in the bottom; and breathing air processing devices operable to maintain air within the evacuation refuge breathable.

2. The evacuation refuge according to claim 1, wherein the breathing air processing devices comprise at least one of ventilation arrangements, reserve of breathing air, regeneration and filtration units.

3. The evacuation refuge according to claim 1, further comprising:

a folding apparatus operable to lower occupied life boats from the rescue station nearer to sea level before releasing the life boats.

4. The evacuation refuge according to claim 1, wherein the evacuation refuge is for a maritime unit operating at sea and further comprises:

sanitary facilities operable to be closed airtight with respect to the surrounding environment.

5. The evacuation refuge according to claim 4, wherein the maritime operating unit comprises an oil drilling rig unit.

6. The evacuation refuge according to claim 4, wherein the sanitary facilities comprise at least one of water closets, chemical toilets, and washing facilities.

7. The evacuation refuge according to claim 1, further comprising:

at least one of a heating apparatus and a cooling apparatus arranged in connection with the rescue station and operable to maintain a temperature inside the rescue station within adjustable temperature limits.

8. An evacuation refuge for a maritime unit, comprising:

a rescue station comprising at least one space operable to be completely closed from a surrounding environment for longterm occupation therein;

a plurality of life boats arranged within the rescue station for emergency exit, such that the life boats are operable to be occupied while inside the rescue station prior to deployment;

an openable or removable structure operable to permit deployment of the life boats arranged within the rescue station by removal of the occupied life boats from the rescue station;

breathing air processing devices operable to maintain air within the evacuation refuge breathable;

a residence unit for personnel;

a helicopter deck; and a food stuffs unit operable to maintain food and drink, to enable long standing residence, and to be closed airtight with respect to the surrounding environment.

9. The evacuation refuge according to claim 8, wherein the foodstuffs unit is common to the residence unit.

10. The evacuation refuge according to claim 8, wherein the breathing air processing devices comprise at least one of ventilation arrangements, reserve of breathing air, regeneration and filtration units.

11. The evacuation refuge according to claim 8, wherein the openable or removable structure comprises an openable or removable outside wall of the rescue station in connection with the life boats and operable to enable removing the life boats from a side of the evacuation refuge.

12. The evacuation refuge according to claim 8, further comprising:

a folding apparatus operable to lower occupied life boats from the rescue station nearer to sea level before releasing the life boats.

13. The evacuation refuge according to claim 8, wherein the evacuation refuge is for a maritime unit operating at sea and further comprises:

sanitary facilities operable to be closed airtight with respect to the surrounding environment.

14. The evacuation refuge according to claim 13, wherein the maritime operating unit comprises an oil drilling rig unit.

15. The evacuation refuge according to claim 13, wherein the sanitary facilities comprise at least one of water closets, chemical toilets, and washing facilities.

16. The evacuation refuge according to claim 8, further comprising:

at least one of a heating apparatus and a cooling apparatus arranged in connection with the rescue station and operable to maintain a temperature inside the rescue station within adjustable temperature limits.

17. An evacuation refuge for a maritime unit, comprising:

a rescue station comprising at least one space operable to be completely closed from a surrounding environment for longterm occupation therein;

a plurality of life boats arranged within the rescue station for emergency exit, such that the life boats are operable to be occupied while inside the rescue station prior to deployment;

an openable or removable structure operable to permit deployment of the life boats arranged within the rescue station by removal of the occupied life boats from the rescue station;

breathing air processing devices operable to maintain air within the evacuation refuge breathable; and observation arrangements operable to permit visual observation of a state of the surrounding environment, wherein the observation arrangements comprise at least one of windows, video cameras, and measurers.

18. The evacuation refuge according to claim 17, wherein the observation arrangements comprise measures and the measurers comprise at least one of gas, temperature, and pressure detectors.

19. The evacuation refuge according to claim 17, wherein the breathing air processing devices comprise at least one of ventilation arrangements, reserve of breathing air, regeneration and filtration units.

20. The evacuation refuge according to claim 17, wherein the openable or removable structure comprises an openable or removable outside wall of the rescue station in connection with the life boats and operable to enable removing the life boats from a side of the evacuation refuge.

21. The evacuation refuge according to claim 17, further comprising:

a folding apparatus operable to lower occupied life boats from the rescue station nearer to sea level before releasing the life boats.

22. The evacuation refuge according to claim 17, wherein the evacuation refuge is for a maritime unit operating at sea and further comprises:

sanitary facilities operable to be closed airtight with respect to the surrounding environment.

23. The evacuation refuge according to claim 22, wherein the maritime operating unit comprises an oil drilling rig unit.

24. The evacuation refuge according to claim 22, wherein the sanitary facilities comprise at least one of water closets, chemical toilets, and washing facilities.

25. The evacuation refuge according to claim 17, further comprising:

at least one of a heating apparatus and a cooling apparatus arranged in connection with the rescue station and operable to maintain a temperature inside the rescue station within adjustable temperature limits.

26. An evacuation refuge for a maritime unit, comprising:

a rescue station comprising at least one space operable to be completely closed from a surrounding environment for longterm occupation therein;

a plurality of life boats arranged within the rescue station for emergency exit, such that the life boats are operable to be occupied while inside the rescue station prior to deployment;

an openable or removable structure operable to permit deployment of the life boats arranged within the rescue station by removal of the occupied life boats from the rescue station;

breathing air processing devices operable to maintain air within the evacuation refuge breathable; and an extra command post operable to control operative functionings of the maritime unit.

27. The evacuation refuge according to claim 26, wherein the extra command post is opearble to control at least one of a drilling unit performing drilling, a residence unit, a transferring apparatus, and an energy supply and operating apparatus of the maritime unit.

28. The evacuation refuge according to claim 26, wherein the breathing air processing devices comprise at least one of ventilation arrangements, reserve of breathing air, regeneration and filtration units.

29. The evacuation refuge according to claim 26, wherein the openable or removable structure comprises an openable or removable outside wall of the rescue station in connection with the life boats and operable to enable removing the life boats from a side of the-evacuation refuge.

30. The evacuation refuge according to claim 26, further comprising:

a folding apparatus operable to lower occupied life boats from the rescue station nearer to sea level before releasing the life boats.

31. The evacuation refuge according to claim 26, wherein the evacuation refuge is for a maritime unit operating at sea and further comprises:

sanitary facilities operable to be closed airtight with respect to the surrounding environment.

32. The evacuation refuge according to claim 31, wherein the maritime operating unit comprises an oil drilling rig unit.

33. The evacuation refuge according to claim 31, wherein the sanitary facilities comprise at least one of water closets, chemical toilets, and washing facilities.

34. The evacuation refuge according to claim 26, further comprising:

at least one of a heating apparatus and a cooling apparatus arranged in connection with the rescue station and operable to maintain a temperature inside the rescue station within adjustable temperature limits.

* * * * *